US009561904B1

(12) United States Patent
Osborn

(10) Patent No.: US 9,561,904 B1
(45) Date of Patent: Feb. 7, 2017

(54) MULTI-PURPOSE DUMPING DEVICE FOR A WASTE COLLECTION VEHICLE

(71) Applicant: Qwik-Tip, Inc., Elk Grove, IL (US)

(72) Inventor: Warren Osborn, Barrington Hills, IL (US)

(73) Assignee: Qwik-Tip, Inc., Elk Grove, IL (US)

( * ) Notice: Subject to any disclaimer, the term of this patent is extended or adjusted under 35 U.S.C. 154(b) by 525 days.

(21) Appl. No.: 13/893,869

(22) Filed: May 14, 2013

(51) Int. Cl.
*B65F 3/04* (2006.01)
*B65F 3/06* (2006.01)
*B65F 3/02* (2006.01)

(52) U.S. Cl.
CPC ..... *B65F 3/046* (2013.01); *B65F 3/041* (2013.01); *B65F 2003/0226* (2013.01); *B65F 2003/0256* (2013.01)

(58) Field of Classification Search
CPC ..... B65F 2003/0279; B65F 2003/023; B65F 3/04; B65F 3/046; B65F 2003/0226; B65F 2003/0256; B65G 65/23
USPC ..... 414/406, 408
See application file for complete search history.

(56) References Cited

U.S. PATENT DOCUMENTS

| | | | | |
|---|---|---|---|---|
| 2,592,085 | A * | 4/1952 | Van Doorne | B65F 3/04 414/406 |
| 3,032,216 | A * | 5/1962 | McCarthy | 414/406 |
| 3,147,870 | A * | 9/1964 | Urban et al. | 414/345 |
| 3,702,662 | A * | 11/1972 | Davieu | 14/303 |
| 4,050,594 | A * | 9/1977 | Gollnick | 414/517 |
| 5,425,613 | A * | 6/1995 | Osborn | 414/408 |
| 5,466,110 | A * | 11/1995 | Redding | B65F 3/046 414/408 |
| 5,720,588 | A * | 2/1998 | Graves | 414/406 |
| 5,807,056 | A * | 9/1998 | Osborn et al. | 414/406 |
| 6,234,739 | B1 * | 5/2001 | Smith et al. | 414/525.51 |
| 6,261,046 | B1 * | 7/2001 | Fryman | 414/410 |
| 7,806,645 | B2 * | 10/2010 | Arrez et al. | 414/408 |
| 8,944,276 | B2 * | 2/2015 | Garagiola | B65F 1/12 206/804 |
| 2003/0053895 | A1 * | 3/2003 | Schrafel | 414/408 |
| 2013/0287541 | A1 * | 10/2013 | Smith et al. | 414/810 |

FOREIGN PATENT DOCUMENTS

| | | | | |
|---|---|---|---|---|
| DE | 19547831 | A1 * | 7/1997 | B65F 3/046 |

* cited by examiner

*Primary Examiner* — James Keenan
(74) *Attorney, Agent, or Firm* — Mathew R. P. Perrone, Jr.; Joseph Whang

(57) ABSTRACT

A multi-purpose dumping device mounted on one vehicle assists with the emptying of both a heavy commercial refuse container and a lighter residential refuse container and easily operable by the current vehicle structure without substantial modification to the tipping mechanism.

8 Claims, 8 Drawing Sheets

MULTI-PURPOSE DUMPING DEVICE FOR A WASTE COLLECTION VEHICLE

This invention relates to a dumping device for picking up and emptying waste containers, and more particularly to a multi-purpose dumping device for a waste collection vehicle, which renders a waste collection vehicle adaptable from a commercial waste collection vehicle to a residential waste collection vehicle, with no major change of the dumping device.

BACKGROUND OF THE INVENTION

Waste collection and proper disposal is of great importance to any civilized society. Such collections of waste are important both for health benefits and efficient management of resources, in a modern society. This is especially true in areas having a high population density.

A typical garbage or trash refuse collection vehicle includes a compacting device for reducing the volume of the garbage. In the rear of the vehicle is generally a receiving bay which receives the refuse dumped therein. A compacting device removes the garbage from the receiving area into an interior area of the vehicle. This receiving area generally receives refuse including trash and garbage from one or more containers. If it is a large container or receptacle desired to be emptied into the base, it is desired to empty these larger containers more efficiently.

In particular, large receptacles, generally referred to as dumpsters, are difficult to efficiently dump into refuse collection vehicles. These dumpsters present laterally extending bar members (referred to as trunnion bars) from their upper front, and these bars are used to grasp, lift and dump the container in cooperation with a lower foot member. Sometimes a smaller container than a dumpster must also be emptied.

The device for emptying a dumpster is not compatible with the device for emptying a smaller container. If a simple modification can be made so that the smaller container can also be emptied, such that the modification to dump a residential container has minimal interference with the device for emptying a dumpster, the advantages become even more apparent.

While collection of trash and garbage is a required element in a modern society, it is at best an unpleasant task and at worst and extremely arduous and uncomfortable task. Many factors are involved in efficiently achieving such collection. For efficient collection, in areas, especially commercial areas, where a large amount of trash and garbage is generated, it is desired to have a large container for receiving this garbage as opposed to a series of smaller containers.

There is a major distinction in the waste disposal industry between commercial waste collection and residential waste collection. Typically, the waste collection is accomplished by a truck having a device, which provides modification designed to pick up containers, and empty the same. It is also very desirable to be able to place a container into a desirable position. Lifting, dumping and returning with the device is a complicated matter.

Clearly, the commercial containers are much larger than the residential containers. There is no effective way to easily convert from commercial collection to residential collection and vice versa. What is common in the industry today is the provision of separate vehicles for residential collection and commercial collection. There is no simple efficient way to provide for residential and commercial waste collection on the same vehicle. Major readjustments or modifications are required for a vehicle to handle both commercial and residential collections on the same trip.

This requirement for separate vehicles for commercial and residential waste collection clearly creates a problem, when a commercial vehicle is in the area where the waste collection company also has some residential accounts. The cost of sending a second vehicle to an area where a first vehicle is present is costly in terms of both vehicle wear and employee time. Thus an efficient manner of adapting a commercial waste collection vehicle for double-duty use as a residential vehicle can provide great advantages.

If such a vehicle can accomplish both commercial and residential pick-ups on the same trip a second vehicle trip can be eliminated. The increased pick-up capability creates savings in employee time, and vehicle wear and tear. When the desired features, providing the increased pickup capability, for both commercial and residential containers on one vehicle, are combined with the ability to desirably reposition the container, great advantages are obtained.

SUMMARY OF THE INVENTION

Among the many objectives of this invention is the provision of a multi-purpose dumping device, which permits a waste collection vehicle to switch easily between a residential waste collection vehicle and a commercial waste collection vehicle.

Another objective of this invention is the provision of a multi-purpose dumping device to permit a commercial waste collection vehicle to accomplish residential pickups on the same trip.

Yet another objective of this invention is the provision of a multi-purpose dumping device, which minimizes the necessity of sending two waste collection vehicles to the same area.

Still another objective of this invention is the provision of a multi-purpose dumping device, which simplifies waste collection.

Also, an objective of this invention is the provision of a multi-purpose dumping device, which may efficiently use employee time.

Additionally, an objective of this invention is to provide a method of attaching an efficient dumping device to provide a waste collection vehicle with both commercial and residential capabilities on the same vehicle during the same pick-up run.

Also, an objective of this invention is the provision of a multi-purpose dumping device, which can assist with the emptying of both a heavy commercial refuse container and a lighter residential refuse container.

A further objective of this invention is the provision of a multi-purpose dumping device, which minimizes damage to a vehicle.

A still further objective of this invention is the provision of a multi-purpose dumping device, which is adaptable to a smaller refuse container.

Yet a further objective of this invention is the provision of a multi-purpose dumping device, which minimizes damage to a refuse container.

These and other objectives of the invention (which other objectives become clear by consideration of the specification, claims and drawings as a whole) are met by providing is the provision of a multi-purpose dumping device to convert a waste collection vehicle from a commercial waste collection vehicle to a residential waste collection vehicle and vice versa while on the same collection route.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
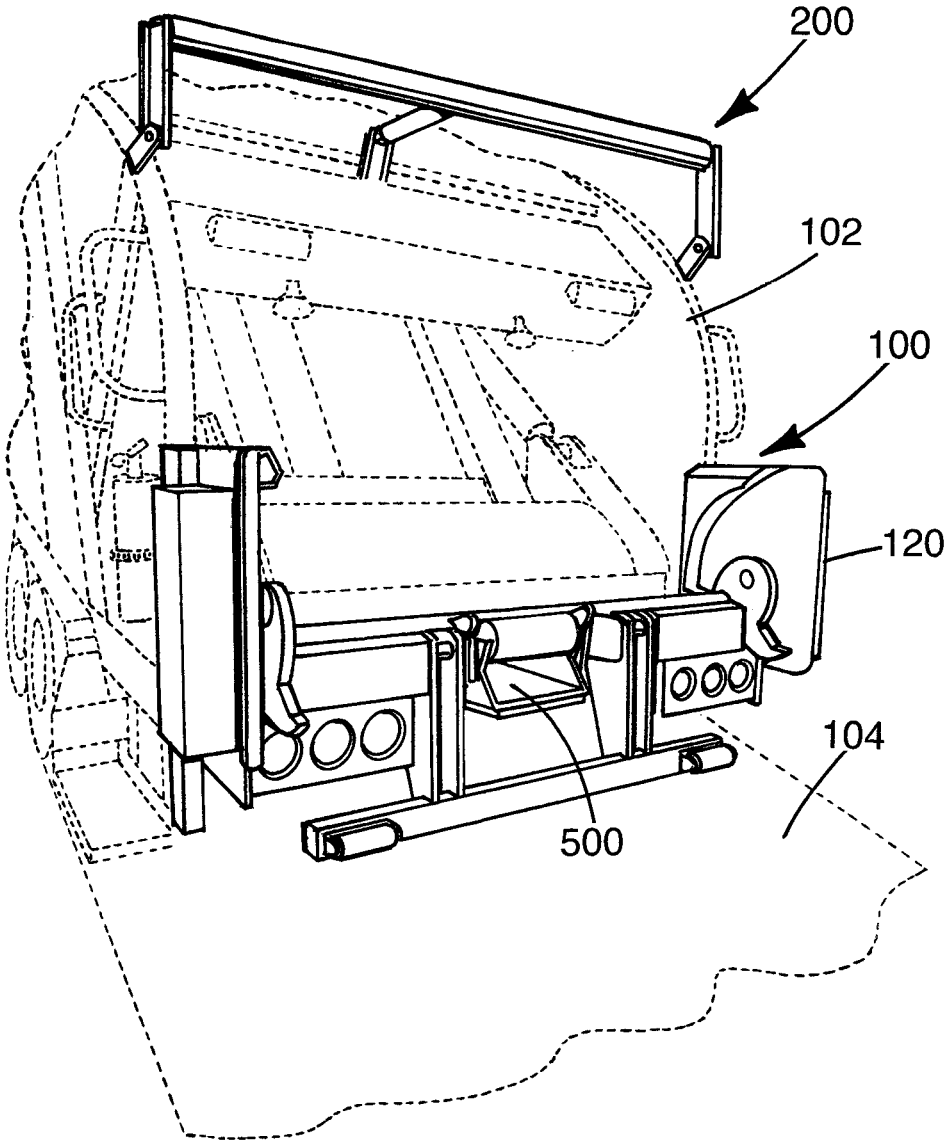
FIG. 1 depicts a perspective view of a multi-purpose dumping device 100 mounted on the rear of truck 102 shown in phantom in accordance with the present invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices. A multi-purpose dumping device rendering a waste collection vehicle adaptable from a commercial waste collection vehicle to a residential waste collection vehicle is easily attached to a waste collection vehicle. This device includes the provision of a multi-purpose dumping device provides both a commercial device and residential pick-up device. It is also easily operable by the current vehicle structure without substantial modification to the tipping mechanism.

The multi-purpose dumping device is usable with any standard waste collection vehicle or garbage truck. This multi-purpose dumping device is especially suitable for use on a commercial device such as that described in U.S. Pat. No. 5,425,613 to Warren Osborn, incorporated herein by reference. In this manner, the described vehicle can pick up and empty both commercial sized and residential sized waste containers on the same route without returning to its base, while retaining the ability to empty either container and put it back into a desired position.

Basically, the multi-purpose dumping device includes an actuator assembly for handling large waste containers and a cart tipper for handling the smaller, usually residential, wheeled containers. Preferably, the cart tipper is centrally mounted on the rear of a waste collection vehicle in the center of an actuator assembly for handling large waste containers.

In FIG. 1, multi-purpose container dumper 100 is mounted for standard waste collection procedures on truck 102. While resting on ground 104, the actuator assembly 120, as part of the multi-purpose container dumper 100, cooperates with the bang bar assembly 200 to empty a commercial dumpster 400. Cart tipper 500 serves the same purpose for the residential container. Many styles of cart tippers 500 are known. An especially suitable device is sold with the trademark revolution, by Bayne Premium Lift Systems of Greenville, S.C. Other cart tippers can also be used.

Figure 2:
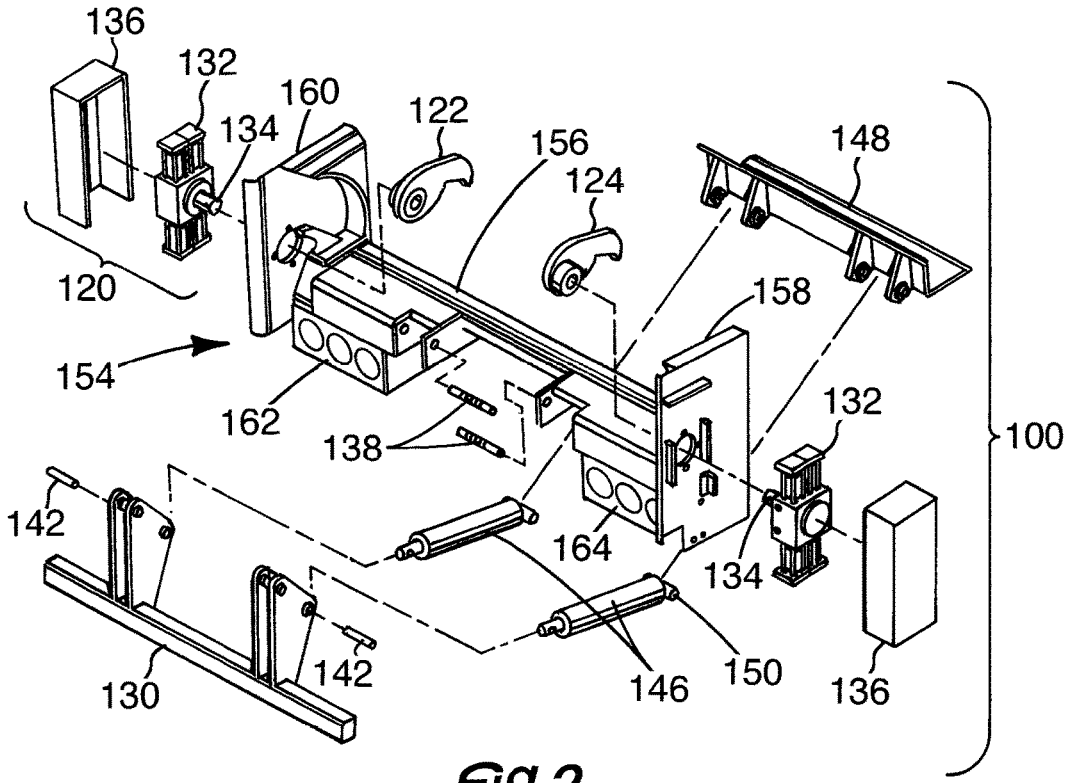
FIG. 2 depicts a perspective view of a multi-purpose dumping device 100 in accordance with the present invention in an exploded view.

Adding FIG. 2 to the consideration, an exploded view of multi-purpose container dumper 100 in general, and actuator assembly 120 in particular, is depicted. Left hook 122 and right hook 124 are mounted above tip bar assembly 130. Each of left hook 122 and right hook 124 are mounted on the shaft 134 of its own actuator 132. Each actuator 132 is covered by an actuator cover 136 clipped, welded, bolted or otherwise secured thereto. Upper cylinder pin 142 secures tip bar lift cylinder 146 to the tip bar assembly 130, while cylinder anchor 148 is secured to flat end 150 of tip bar lift cylinder 146. This assembly is welded to truck 102 in a standard fashion. By the same token, welded base frame assembly 154 is secured to truck 102 (FIG. 1).

More particularly, welded base frame assembly 154 has a bolster 156 as a support bar with a first side plate 158 and a second side plate 160 mounted on either end thereof, by gluing, welding, bolting or securing means or device. Positioned adjacent to first side plate 158 is first light housing 164, while adjacent to second side plate 160 is second light housing 162. Typically, the first light housing 164 and the second light housing 162 are bolted or otherwise secured to the welded base frame assembly. A bolster pin 138 supports the tip bar assembly 130.

Figure 3:
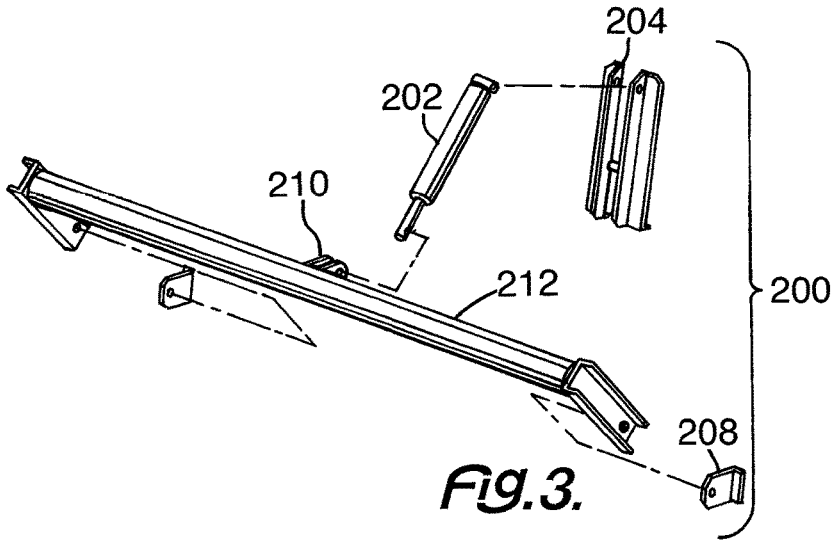
FIG. 3 depicts a perspective view of a bang bar assembly 200 for use with the multi-purpose dumping device 100 in accordance with the present invention in an exploded view.

Further adding FIG. 3 to the consideration, the structure of bang bar assembly 200 becomes more clear. Bang bar cylinder 202 has a bang bar cylinder anchor 204 secured at one end thereof. A pair of pivot brackets 208 have centrally mounted therebetween a cylinder coupling bracket 210. More specifically, each pivot bracket is mounted at opposing end of the bang bar striker 212, while the cylinder coupling bracket 210 is centrally mounted on the bang bar striker 212 and secured to bang bar cylinder 202.

Figure 4:
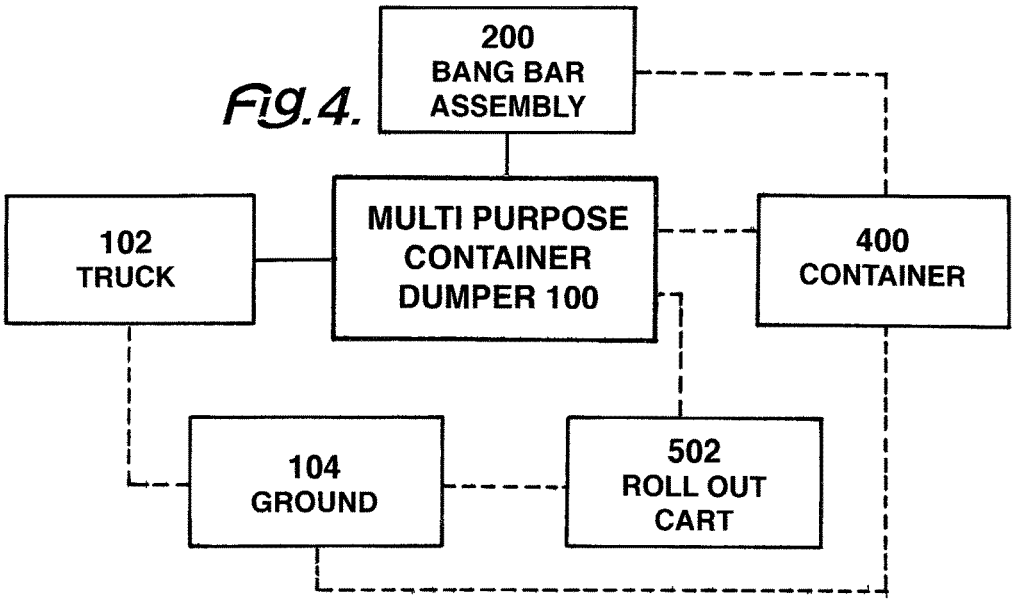
FIG. 4 depicts the multi-purpose dumping device 100 in accordance with the present invention in a box chart representing functional relationship of this multi-purpose dumping device 100 in use.
Figure 5:
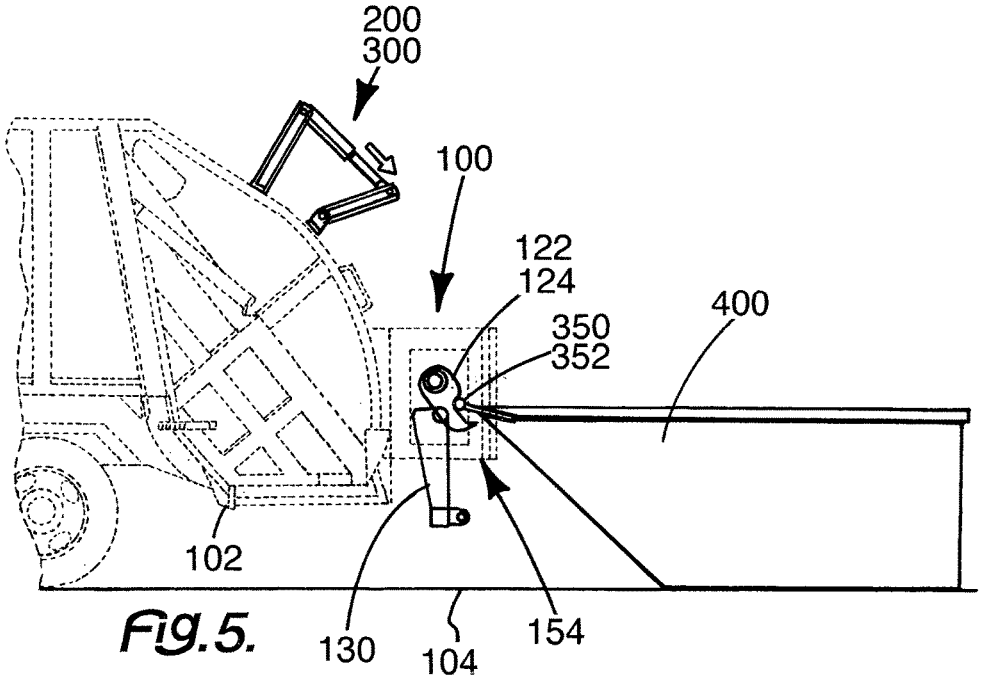
FIG. 5 depicts the multi-purpose dumping device 100 in accordance with the present invention with truck 102 and welded or otherwise secured to base frame assembly 154 shown in phantom in use on a commercial dumpster 400, with trunions 350 of device 100 in contact position 352 with right hook 124 and left hook 142.

For clarification of the assembly, FIG. 4 may be considered. Multi-purpose container dumper 100 is mounted on truck 102 to empty either a large waste container such as dumpster 400 or a smaller container such as roll out cart 502. Bang bar assembly 200 provides contact with the lifted dumpster 400 and provides a jarring note to assist with the transfer of material from the dumpster 400 into the truck 102.

Turning now to the consideration of FIG. 5, FIG. 6, FIG. 7, FIG. 8, FIG. 9, FIG. 10, and FIG. 11, the empty process and return process for the dumpster 400 is depicted. Multi-purpose container dumper 100 for truck 102 situated on ground 104 has left hook 122 and right hook 124 are positioned on trunion 350 of dumpster 400 in contact position 352. As left hook 122 and right hook 124 make contact with each end of trunion 350, the design thereof positions the trunnion 350 and the dumpster 400 in a proper position.

Figure 6:
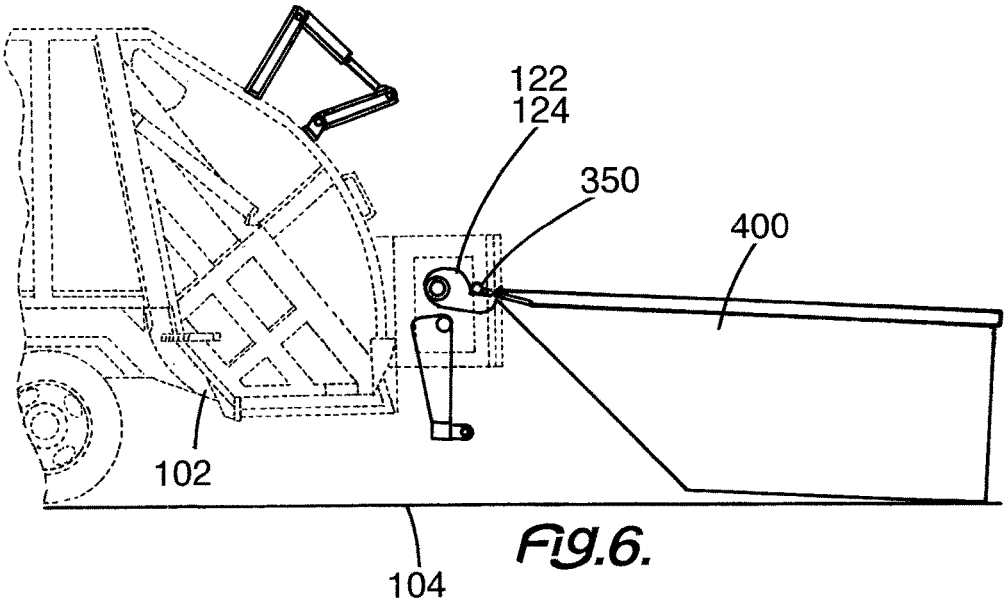
FIG. 6 depicts the multi-purpose dumping device 100 in accordance with the present invention with truck 102 including right hook 124 and left hook 122 having trunions 350 resting on thereon in order to align commercial dumpster 400 to be raised.
Figure 7:
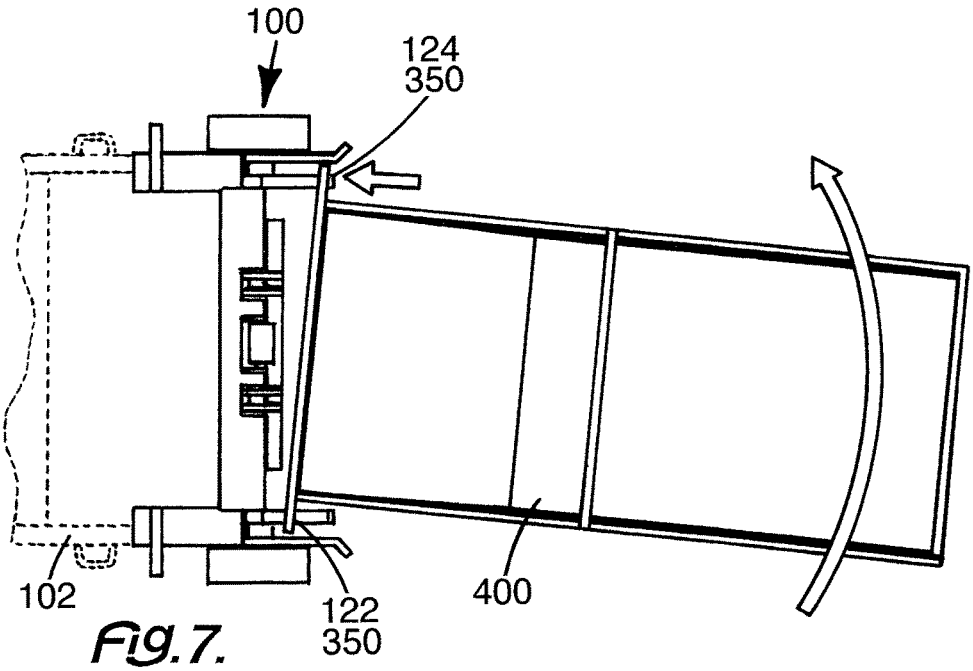
FIG. 7 depicts a top view of the multi-purpose dumping device 100 based on FIG. 6.
Figure 8:
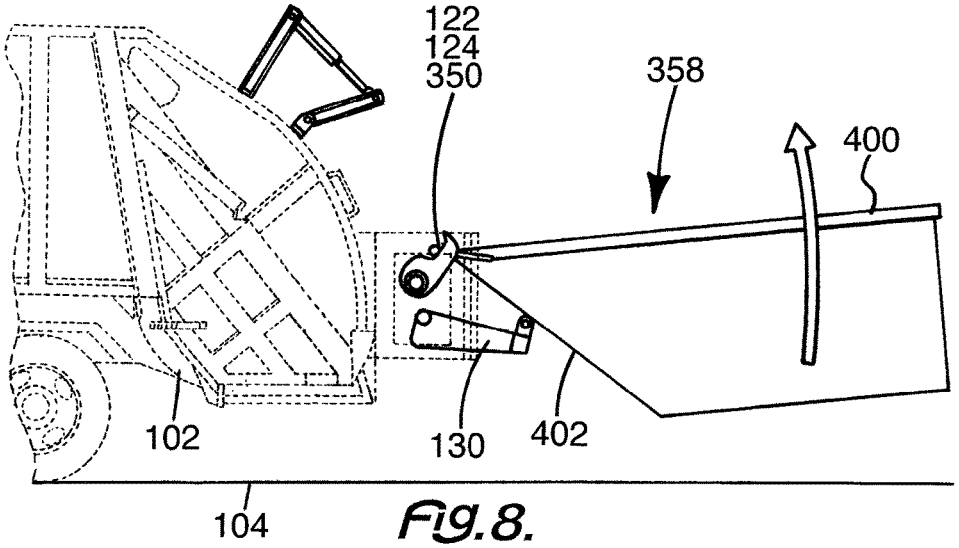
FIG. 8 depicts the multi-purpose dumping device 100, in accordance with the present invention, with the lifting and drawing in of the commercial dumpster 400, by right hook 124 and left hook 122 assisted by the tip bar assembly 130.
Figure 9:
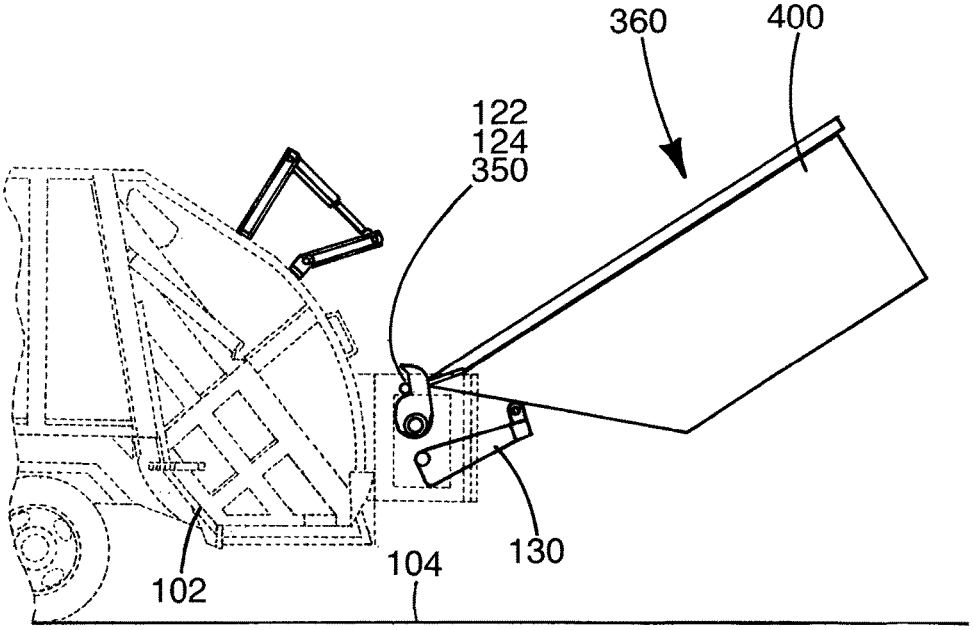
FIG. 9 depicts the multi-purpose dumping device 100 as shown in FIG. 8, in accordance with the present invention, with the lifting and drawing in of the commercial dumpster 400, by both right hook 124 and left hook 122 as assisted by the tip bar assembly 130 and the raising thereof through its rotation cycle.
Figure 10:
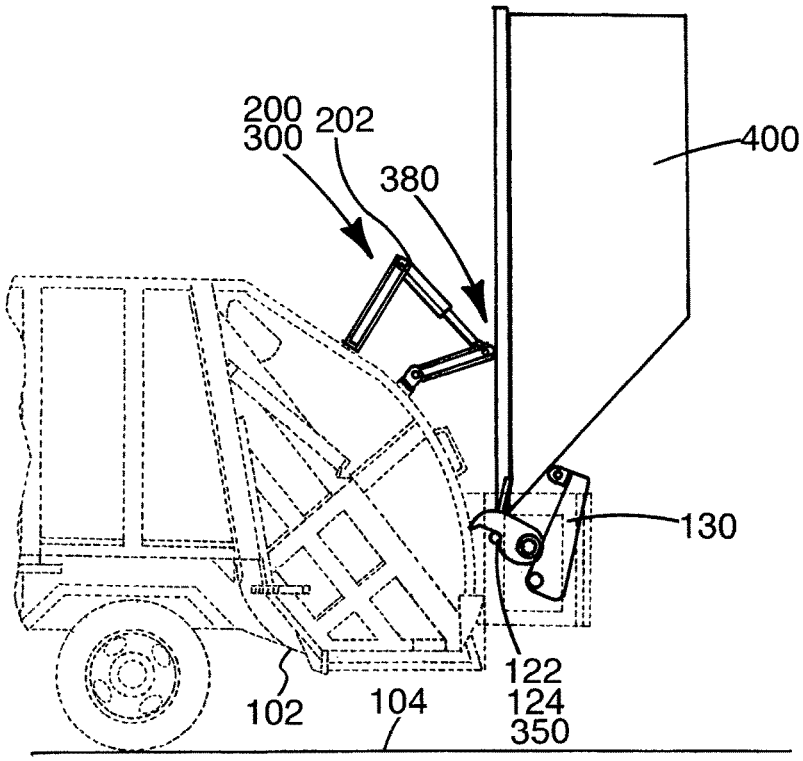
FIG. 10 depicts the multi-purpose dumping device 100 in accordance with the present invention showing the dump and bump position 380 of the commercial dumpster 400 in order to empty the same as it completes the rotation cycle.
Figure 11:
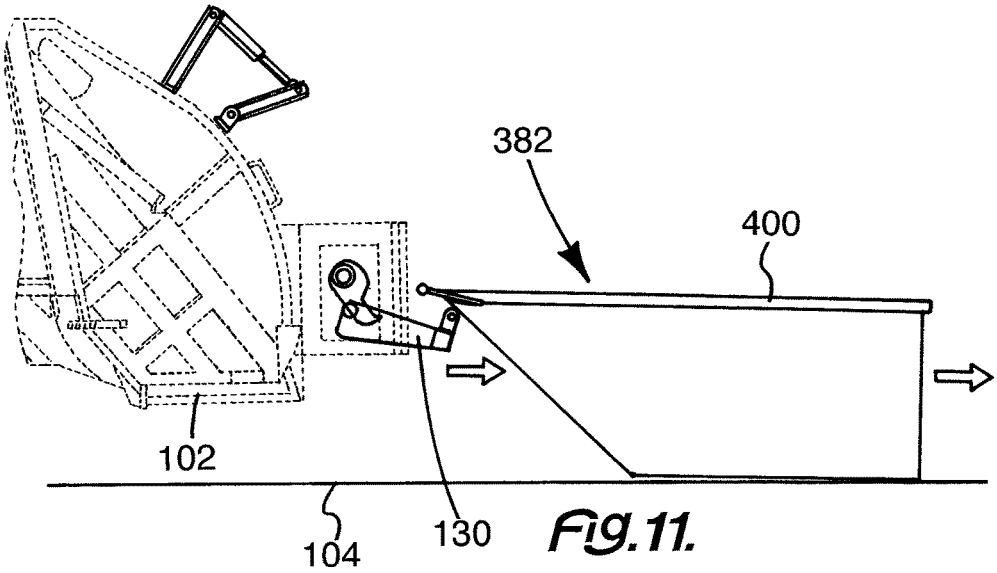
FIG. 11 depicts the multi-purpose dumping device 100 in accordance with the present invention by demonstrating the push back action 382 of the tip bar assembly 130 to place the commercial dumpster 400 back to its designated place when dumping is completed.
Figure 12:
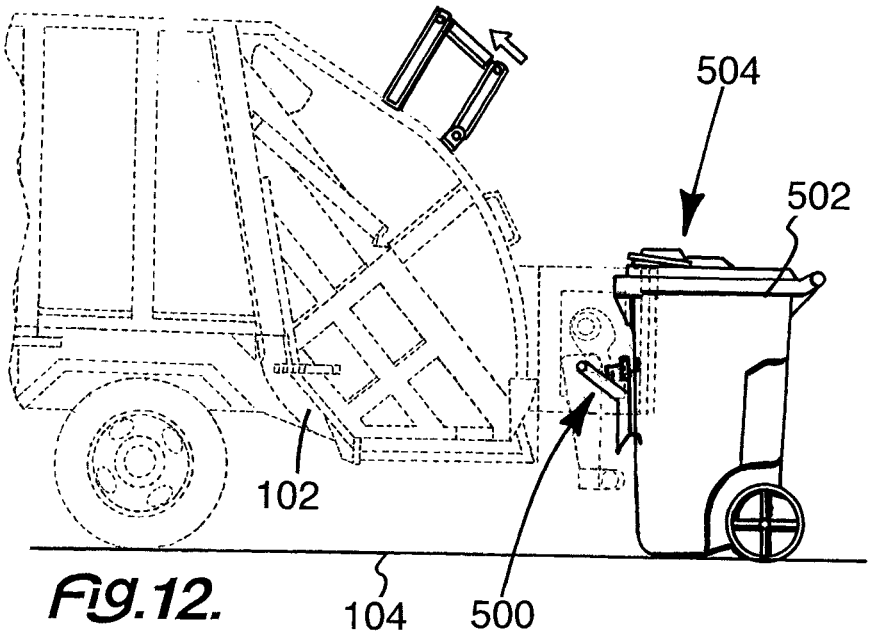
FIG. 12 depicts the multi-purpose dumping device 100 in accordance with the present invention with roll out cart 502 in the grip position 504 so that it may be rotated by cart tipper 500.

Left hook 122 and right hook 124 achieve contact position 352 (FIG. 5), which leads to lift and align position 356 (FIG. 6). From lift and align position 356, dumpster 400 moves to pull and lift position 358 (FIG. 8), then followed by raise position 360 (FIG. 9). From raise position 360, dumpster 400 moves to dump and bump position 380 (FIG. 10).

Dump and bump position 380 brings dumpster 400 into contact with bang bar assembly 200, as bang bar assembly 200 position of bang bar deployed 300. Bang bar cylinder 202 achieves that position of bang bar deployed 300. Bang bar cylinder anchor 204, pivot bracket 208, and cylinder coupling bracket 210 provide contact for bang bar assembly 200 and bang bar striker 212.

As dumpster 400 is lowered back to ground 104, proper relocation is achieved with a push back action 382 of the tip bar assembly 130. As can be seen (FIG. 11), tip bar assembly 130 contacts dumpster 400 below trunion 350. As left hook 122 and right hook 124 contact trunion 350, and lift or lower dumpster 400, the cooperation of tip bar assembly 130 is useful.

Figure 13:
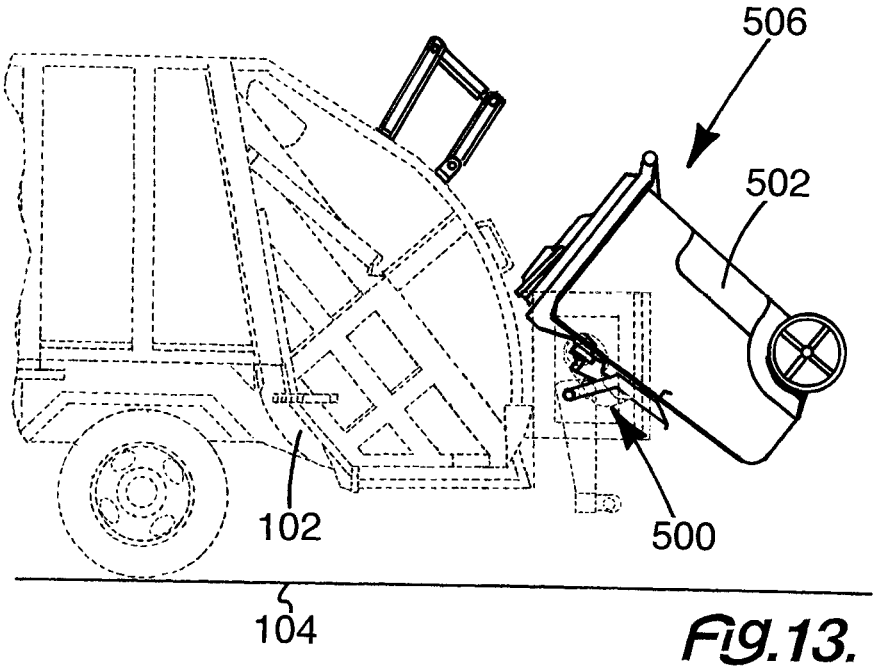
FIG. 13 depicts the multi-purpose dumping device 100 in accordance with the present invention showing the lift cart position 506 of the roll out cart 502 by cart tipper 500, based on FIG. 12.
Figure 14:
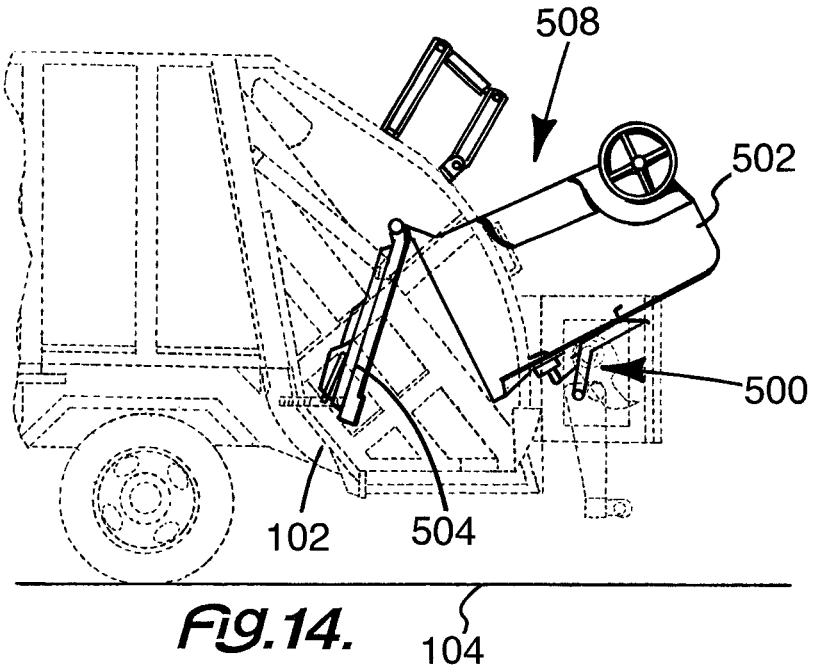
FIG. 14 depicts the multi-purpose dumping device 100 in accordance with the present invention showing the rotation dump position 508 of the roll out cart 502 by cart tipper 500.
Figure 15:
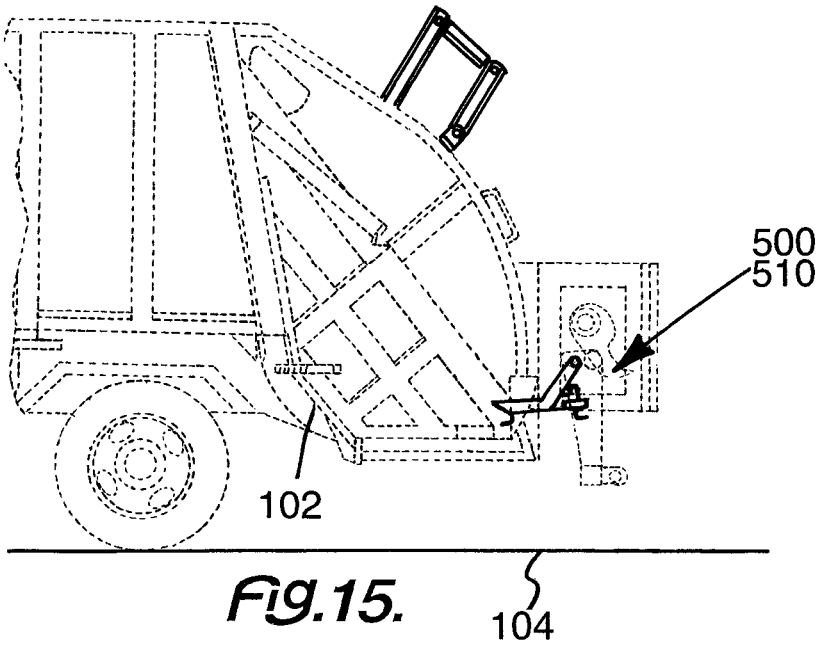
FIG. 15 depicts the multi-purpose dumping device 100 in accordance with the present invention, showing the storage position 510 of the cart tipper 500 on the multi-purpose dumping device 100.

When FIG. 12, FIG. 13, FIG. 14, and FIG. 15 are considered, cart tipper 500 is shown in use on truck 102. While resting on ground 104. Residential trash container or roll out cart 502 achieves a grip position 504 (FIG. 12) shows the initial position of roll out cart 502. As cart tipper 500 elevates roll out cart 502, lift cart position 506 is achieved (FIG. 13). From lift cart position 506, cart lid 504 exposes the contents of roll out cart 502 in the rotate and dump position 508 (FIG. 14). Then the roll out cart 502 can be held in a storage position 510 on truck 102, or returned to the ground 104.

In this fashion, it becomes clear that the multi-purpose container dumper 100 of this invention is suitable for a dumpster 400 or a roll out cart 502. Both of these waste containers can be handled by the same truck 102 in view of the multi-purpose container dumper 100. Such flexibility provides great advantage by greatly improving the efficiency of waste collection.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A multi-purpose dumping device for a waste collection vehicle, comprising:

the multi-purpose dumping device including an actuator assembly for handling a large waste container and a cart tipper for handling a smaller container;

the actuator assembly cooperating with a bang bar assembly to empty a large waste container;

the actuator assembly having a tip bar assembly in cooperation with a left hook and a right hook;

the left hook and the right hook being mounted above the tip bar assembly;

the left hook being mounted on a first actuator;

the right hook being mounted on a second actuator;

the actuator assembly being mounted on a base frame assembly;

the first actuator being covered by a first actuator cover;

the second actuator being covered by a second actuator cover;

the base frame assembly being mounted on the vehicle;

the base frame assembly supporting the tip bar assembly;

the tip bar assembly including a tip bar lift cylinder;

an upper cylinder pin securing the tip bar lift cylinder to the tip bar assembly;

a cylinder anchor being secured to the end of the tip bar lift cylinder;

the cart tipper being centrally mounted on a rear portion of the waste collection vehicle in relation to the actuator assembly;

the cart tipper serving to dump a residential container;

the base frame assembly having a support bar with a first side plate and a second side plate mounted on either end thereof;

a first light housing being mounted adjacent to the first side plate;

a second light housing being mounted adjacent to the second side plate;

a bolster pin supporting the tip bar assembly on the base frame assembly;

the bang bar assembly including a bang bar cylinder and a bang bar striker;

the bang bar cylinder having a bang bar cylinder anchor secured at one end thereof; and a pair of pivot brackets for the bang bar cylinder having centrally mounted therebetween a cylinder coupling bracket.

2. The multi-purpose dumping device of claim 1 further comprising:

a) each member of the pair of pivot brackets being mounted at an opposing end of the bang bar striker;

b) the cylinder coupling bracket being centrally mounted on the bang bar striker and secured to the bang bar cylinder;

c) the large waste container being a dumpster;

d) the bang bar assembly providing contact with the dumpster as the dumpster is lifted in order to be emptied into the vehicle;

e) the vehicle being a truck; and f) the bang bar assembly providing a jarring note to assist with the transfer of material from the dumpster into the truck.

3. The multi-purpose dumping device of claim 2 further comprising:

a) the left hook and the right hook being positionable on opposing ends of a trunion of the dumpster;

b) the left hook and the right hook contacting on the opposing ends of the trunion to position the dumpster for lifting;

c) the dumpster contacting the bang bar assembly to empty the dumpster after lifting; and d) a tip bar assisting with the lifting or positioning of the dumpster.

4. The multi-purpose dumping device of claim 3 further comprising:

a) the cart tipper being centrally mounted on the base frame assembly; and b) the cart tipper receiving a residential trash container in a grip position.

5. In a waste collection vehicle, the improvement comprising:

a multi-purpose dumping device being provided for a waste collection vehicle;

the multi-purpose dumping device including an actuator assembly for handling a large waste container and a cart tipper for handling a smaller container;

the actuator assembly cooperating with a bang bar assembly to empty a large waste container;

the actuator assembly having a tip bar assembly in cooperation with a left hook and a right hook;

the left hook and the right hook being mounted above the tip bar assembly;

the left hook being mounted on a first actuator;

the right hook being mounted on a second actuator;

the actuator assembly being mounted on a base frame assembly;

the first actuator being covered by a first actuator cover;

the second actuator being covered by a second actuator cover;

the base frame assembly being mounted on the vehicle;

the base frame assembly supporting the tip bar assembly;

the tip bar assembly including a tin bar lift cylinder;

an upper cylinder pin securing the tip bar lift cylinder to the tip bar assembly;

a cylinder anchor being secured to the end of the tip bar lift cylinder;

the cart tipper being centrally mounted on a rear portion of the waste collection vehicle in relation to the actuator assembly;

the cart tipper serving to dump a residential container;

the base frame assembly having a support bar with a first side plate and a second side plate mounted on either end thereof;

a first light housing being mounted adjacent to the first side plate;

a second light housing being mounted adjacent to the second si elate;

a bolster pin supporting the tip bar assembly on the base frame assembly;

the bang bar assembly including a bang bar cylinder and a bang bar striker;

the bang bar cylinder having a bang bar cylinder anchor secured at one end thereof; and a pair of pivot brackets for the bang bar cylinder having centrally mounted therebetween a cylinder coupling bracket.

6. The waste collection vehicle of claim 5 further comprising:

a) each member of the pair of pivot brackets being mounted at an opposing end of the bang bar striker;

b) the cylinder coupling bracket being centrally mounted on the bang bar striker and secured to the bang bar cylinder;

c) the large waste container being a dumpster;

d) the bang bar assembly providing contact with the dumpster as the dumpster is lifted to be emptied;

e) the vehicle being a truck; and f) the bang bar assembly providing a jarring note to assist with the transfer of material from the dumpster into the truck.

7. The waste collection vehicle of claim 6 further comprising:

a) the left hook and the right hook being positionable on opposing ends of a trunion of the dumpster;

b) the left hook and the right hook contacting on the opposing ends of the trunion to position the dumpster for lifting;

c) the dumpster contacting the bang bar assembly to empty the dumpster after lifting; and d) a tip bar assisting with the lifting or positioning of the dumpster.

8. The waste collection vehicle of claim 7 further comprising:

a) the cart tipper being centrally mounted on the base frame assembly; and b) the cart tipper receiving a residential trash container in a grip position.

* * * * *